US010550502B2

(12) United States Patent
Schinasi

(10) Patent No.: US 10,550,502 B2
(45) Date of Patent: Feb. 4, 2020

(54) METHOD FOR PRODUCTION OF BAGS FOR THE TRANSPORT AND STORAGE OF BULK GOODS OR LIQUIDS

(71) Applicant: Codefine S.A., Lausanne (CH)

(72) Inventor: Piero Schinasi, Epalinges (CH)

(73) Assignee: Codefine S.A., Lausanne (CH)

( * ) Notice: Subject to any disclaimer, the term of this patent is extended or adjusted under 35 U.S.C. 154(b) by 57 days.

(21) Appl. No.: 15/625,242

(22) Filed: Jun. 16, 2017

(65) Prior Publication Data

US 2017/0361562 A1 Dec. 21, 2017

(30) Foreign Application Priority Data

Jun. 17, 2016 (EP) ..... 16174949
Jun. 17, 2016 (EP) ..... 16174965

(51) Int. Cl.
*D05B 13/00* (2006.01)
*D05B 35/08* (2006.01)
*B65D 30/20* (2006.01)

(52) U.S. Cl.
CPC ..... *D05B 13/00* (2013.01); *B65D 31/10* (2013.01); *D05B 35/085* (2013.01)

(58) Field of Classification Search
CPC ..... D05B 13/00; D05B 13/02; D05B 35/02; D05B 35/08; D05B 35/085
USPC ..... 112/475.06, 10
See application file for complete search history.

(56) References Cited

U.S. PATENT DOCUMENTS 3,291,375 A 12/1966 Lepisto
4,646,357 A 2/1987 Nattrass
5,556,205 A * 9/1996 Gallie ..... B65D 88/1631 383/105
6,371,646 B1 4/2002 Lafleur
(Continued)

FOREIGN PATENT DOCUMENTS

AT 508364 A4 1/2011
EP 0000838 A1 2/1979
(Continued)

OTHER PUBLICATIONS

European Search Report; European Patent Office; European Patent Application No. 16174949; dated Nov. 25, 2016; 3 pages.
(Continued)

*Primary Examiner* — Danny Worrell
(74) *Attorney, Agent, or Firm* — Taft Stettinius & Hollister LLP

(57) ABSTRACT

The present invention relates to a method for production of bags for the transport and storage of bulk goods or liquids, wherein use is made of tubular fabric cut into several pieces, which are then assembled together, including the steps of:

providing a tubular fabric;

flattening the tubular fabric to form a first double-thickness fabric having two opposite sides, respectively an internal side and an external side, extending between two flattened edges;

folding-in or pleating at least one of the flattened edges of the double-thickness fabric to form a gusset;

cutting the tubular fabric into pieces and assembling the pieces to form a bag;

wherein the assembly of two of the pieces includes the steps of:

(Continued)

assembling the first and second pieces by means of seams formed around or near first to fourth gusset ends.

13 Claims, 9 Drawing Sheets

(56) References Cited

U.S. PATENT DOCUMENTS

| | | | | |
|---|---|---|---|---|
| 6,527,445 | B2 * | 3/2003 | LaFleur | B65D 88/1618 383/120 |
| 6,694,528 | B1 | 2/2004 | Chang | |
| 6,739,753 | B2 * | 5/2004 | Richardson, Jr. | B65D 88/1618 220/495.03 |
| 6,935,782 | B2 * | 8/2005 | Cholsaipant | B65D 88/1612 383/24 |
| 7,798,711 | B2 * | 9/2010 | Plunkett | B65D 75/5877 383/11 |
| 8,950,346 | B2 | 2/2015 | Schinasi | |
| 10,131,470 | B2 * | 11/2018 | Diao | B65D 33/105 |
| 2003/0235350 | A1 | 12/2003 | Richardson et al. | |
| 2005/0188907 | A1 | 9/2005 | Henin | |
| 2012/0314979 | A1 * | 12/2012 | Heininga | B65D 31/10 383/200 |
| 2013/0209002 | A1 * | 8/2013 | Bazbaz | B32B 5/024 383/200 |
| 2013/0305664 | A1 * | 11/2013 | Arroyo Yillan | B29C 65/02 53/469 |
| 2014/0363106 | A1 | 12/2014 | Schnaars, Sr. et al. | |

FOREIGN PATENT DOCUMENTS

| | | | |
|---|---|---|---|
| EP | 0661223 | A1 | 7/1995 |
| GB | 1062552 | A | 3/1967 |
| GB | 2301087 | A | 11/1996 |
| JP | 2004033548 | A | 2/2004 |
| JP | 2005118400 | A | 5/2005 |
| WO | 2013070516 | A1 | 5/2013 |

OTHER PUBLICATIONS

European Search Report; European Patent Office; European Patent Application No. 16174965; dated Nov. 25, 2016; 2 pages.

* cited by examiner

METHOD FOR PRODUCTION OF BAGS FOR THE TRANSPORT AND STORAGE OF BULK GOODS OR LIQUIDS

CROSS-REFERENCE TO RELATED APPLICATIONS

This application claims priority to European Application No. 16174965.0 and European Application No. 16174949.4, each filed on Jun. 17, 2016, the contents of both applications incorporated herein by reference in their entirety.

TECHNICAL FIELD

The present invention relates to a method for production of bags for the transport and storage of bulk goods or liquids, as well as the bag obtained according to the method.

STATE OF THE ART

Bags for the transport and storage of bulk goods or liquids, which are also known as "big bags", are in general made of fabrics woven from polypropylene, which fabrics may or may not be laminated. The most common method for production of bags of this type consists of sewing together a plurality of pieces of fabric, so as to form a rectangular parallelepiped.

For this purpose, it is possible to use tubular fabrics produced by means of circular looms, the pieces which are designed to be sewn together to form the bag being constituted by sections of tubular fabric which are flattened to form lengths of flat double-thickness fabric, the width of which is half the circumference of the tube.

Since pieces of fabric are to be sewn together to form the bag, use is generally made of sewing machines with one needle or two needles, such those described in the patent applications GB-A-2 301 087, JP-A-2004 033548 or JP-A-2005 118400. In the case of machines with two needles, the needles work in parallel, generally at a distance of approximately 0.5 to 1 cm, in order to produce two parallel seams which increase the strength of the assembly. An example of a machine of this type is represented schematically in FIG. 3 of U.S. Pat. No. 8,950,346 B2. Such machines are however not adapted for producing bags that are used for the storage and transport of powdery goods, because the powder may escape via the sewing holes. U.S. Pat. No. 8,950,346 B2 relates to a method permitting to sew together pieces of fabric without forming sewing holes. This method uses a sewing machine comprising at least two needles operating in line one behind the other in one and the same direction so as to form a seam along a single line. Thus the perforation produced by the first needle is covered by the stitch of the second needle and the perforation produced by the second needle is made through the thread of the stitch made by the first needle, thus filling said perforation with said thread.

One disadvantage of these known methods is the relative weakness of the assembly due to the fact that stresses applied by the content of a bag are concentrated on the seam line separating two adjacent lateral walls of said bag. This may become particularly problematic in the specific case of big bags with nominal weights of approximately 250 to 3000 kilos. When these bags are completely filled, the seams are subjected to the full weight of the container's content. Therefore, this is a risk that these seams are torn or break.

DISCLOSURE OF THE INVENTION

The object of the present invention is to propose a method for production of bags for the transport and storage of bulk goods or liquids, which makes it possible in particular to overcome the above-described disadvantages.

For this purpose, the present invention relates to a method for production of bags for the transport and storage of bulk goods or liquids, wherein use is made of tubular fabric cut into several pieces, which are then assembled together, comprising the steps of:

providing a tubular fabric;

flattening said tubular fabric to form a first double-thickness fabric having two opposite sides, respectively an internal side (11*a*) and an external side (11*b*), extending between two flattened edges (12, 14);

folding-in or pleating a first (12) of the flattened edges (12, 14) of said double-thickness fabric (10) to form a first gusset (20), said first gusset (20) being defined by a first oblique section (13) extending between said folded-in flattened edge (12) and a first gusset end (15) positioned on the external side (11*b*) of the first double-thickness fabric (10) and by a second oblique section (17) extending between said folded-in flattened edge (12) and a second gusset end (19) positioned on the internal side (11*a*) of the first double-thickness fabric (10);

folding-in or pleating the second (14) of the flattened edges (12, 14) in a manner symmetric to said first edge (12), cutting said tubular fabric into pieces and assembling said pieces to form a bag, wherein the assembly of two said pieces (10, 10') comprises the steps of:

disposing the first and the second pieces (10, 10') such that the external side (11*b'*) of the second piece (10') is in contact with or close to the internal side (11*a*) of the first piece (10) and such that the first, second, third and fourth gusset ends (15, 19, 15', 19') of said pieces are substantially aligned;

assembling the first and second pieces (10, 10') by means of seams (23) formed around or near the first to fourth gusset ends (15, 19, 15', 19')

The present invention also relates to a bag for the transport and storage of bulk goods or liquids according to claim 9.

Other important characteristics of the invention form the basis of the dependent claims, and are discussed hereinafter.

BRIEF DESCRIPTION OF THE DRAWINGS

The following description is provided by way of non-limiting examples. It relates to the drawing, in which.

DETAILED DESCRIPTION OF THE EMBODIMENTS OF THE INVENTION

The bags according to the invention are made of pieces constituted by sections of tubular fabric flattened so as to form lengths of flat double-thickness fabric, the width of which is half the circumference of the tube. Pieces of fabric of this type can be square or rectangular and form either the bottom or one of the lateral walls of the bag. It is also possible that one piece of fabric is designed to constitute both the bottom of the bag and two opposite lateral walls, two complementary pieces being designed to constitute the two other lateral walls of the bag. In the conventional bag, the assembly of two adjacent pieces of fabric of the bag are carried out by sewing along a single line, which is parallel to the sides of the pieces. Such a configuration is for example illustrated in FIGS. 1 and 2 of U.S. Pat. No. 8,950,346 B2. In this configuration, stresses applied on the bag by its content are transmitted directly to the single line. A deterioration of the seam may thus occur in use, which leads to an imperfect sealing against the powders, and, therefore, to a possible loss of content if the bag contains powders or other similar products.

To avoid this problem, the essential concept of the production method according to the invention consists to form a gusset at one end of the pieces of fabric and to provide this gusseted end with several connecting lines or areas, said connecting lines or areas being positioned so as to distribute stresses on several portions of the pieces of fabric when they are assembled together.

The production and assembly of two adjacent pieces of fabric for the formation of a bag according to the invention will be better understood by reference to FIGS. 1 to 7 and 1*a* to 7*a*.

Figure 1:
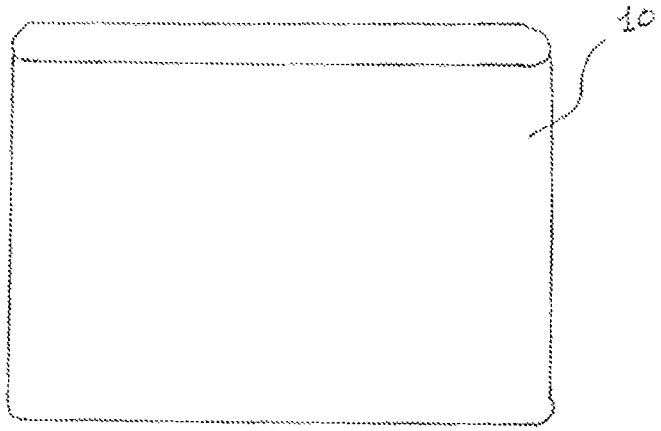
FIGS. 1 and 1*a* are respectively perspective and top schematic views of a tubular fabric used for making a bag in accordance with the invention.
Figure 1A:
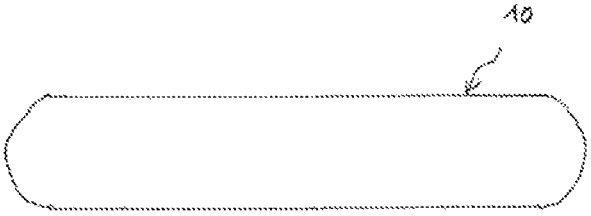

Referring firstly to FIGS. 1 and 1*a*, one starts with a tubular fabric 10 weighing preferably 75 to 125 grams per square meter. The tubular fabric 10 has an appropriate diameter and length which is determined by the desired dimensions of the finished bag.

Figure 2:
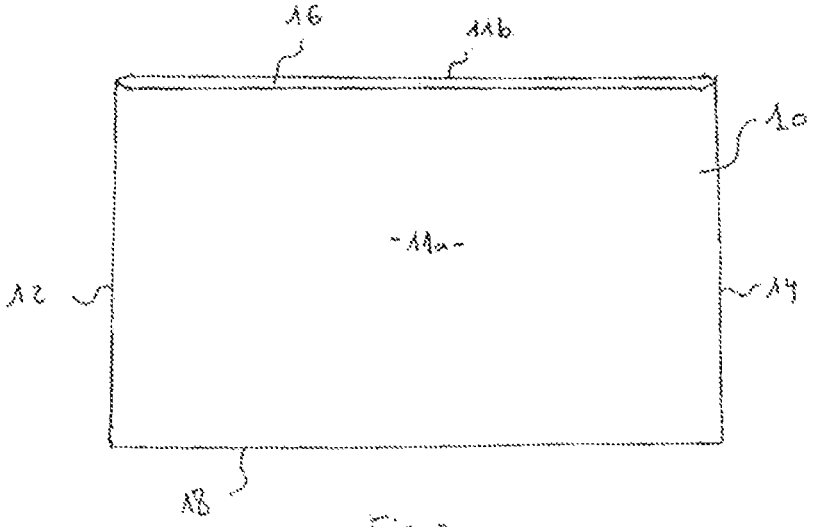
FIGS. 2 and 2*a* are similar views to FIGS. 1 and 1*a*, but illustrating the tubular fabric having been flattened to form a double-thickness fabric.
Figure 2A:
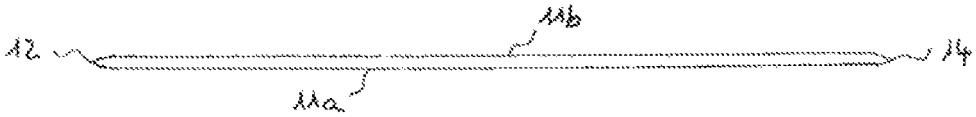

Referring to FIGS. 2 and 2*a*, this tubular fabric 10 is then flattened so as to form a double-thickness fabric having two opposite sides, respectively an internal side 11*a* and an external side 11*b*, extending between two flattened edges, respectively a left edge 12 and a right edge 14, and two open or cut edges 16, 18.

Figure 3A:
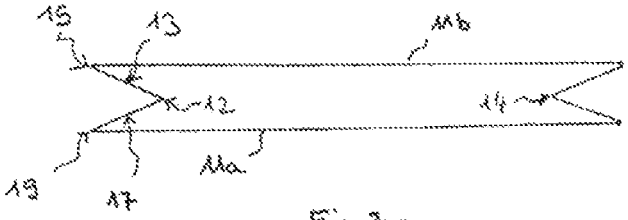
FIGS. 3 and 3*a* are similar views to FIGS. 2 and 2*a*, but illustrating the double-thickness fabric after the formation of a gusset at its flattened ends.
Figure 3:
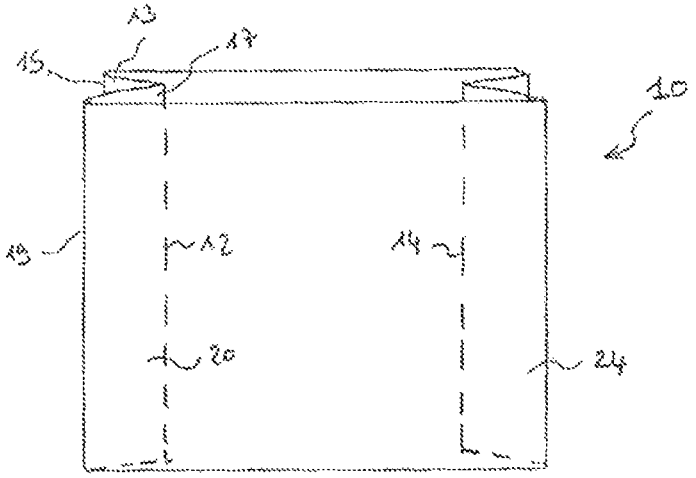

Referring to FIGS. 3 and 3*a*, a gusset 20 is now formed by folded in or pleating the double-thickness fabric 10 at the portion adjacent the left edge 12, said left edge 12 projecting inwards in the fabric 10 to an extent of several cm for example. Gusseting to achieve the gusset 20 may be effected as the tubular fabric 10 is flattened, and may be effected by appropriate shaping tools (not shown) past which the tubular fabric progresses, simultaneously with a gusset 24 at the right edge 14. The gusset 20 is thus defined by a first oblique section 13 extending between the folded-in left edge 12 and a first gusset end 15 positioned on the external side 11*b* of the fabric 10 and by a second oblique section 17 extending between said folded-in left edge 12 and a second gusset end 19 positioned on the internal side 11*a* of the fabric 10.

So prepared, the tubular fabric is cut into pieces to be assembled to form a bag.

Figure 4A:
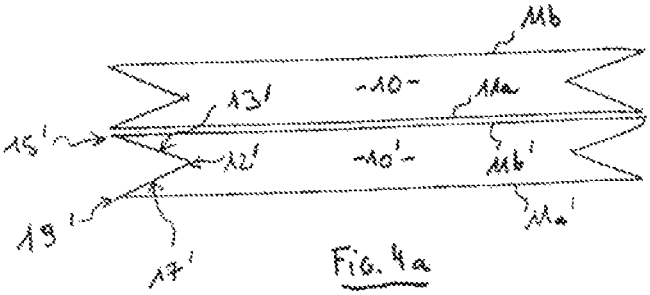
FIGS. 4 and 4*a* are similar views to FIGS. 3 and 3*a*, but illustrating a pair of double-thickness pieces of fabric having been disposed for their assembling.
Figure 4:
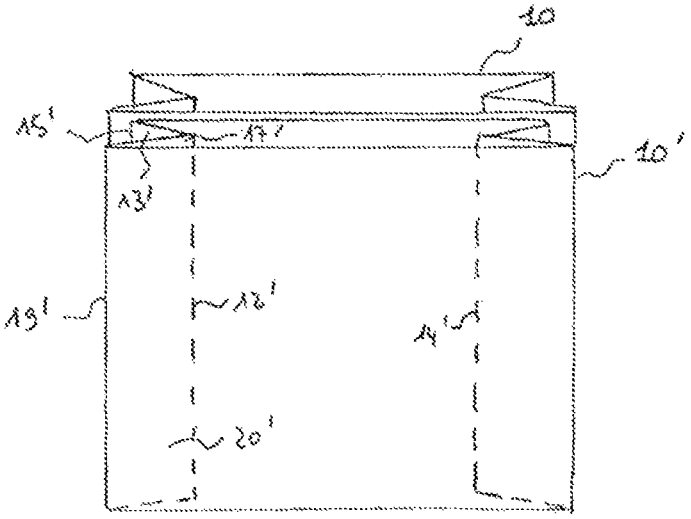

Referring to FIGS. 4 and 4*a*, the piece of fabric 10 of FIGS. 3 and 3*a* is disposed adjacent to a similar piece of fabric 10'. Said piece of fabric 10' is in particular defined by an internal side 11*a*', an external side 11*b*', a left edge 12' projecting inwards and a gusset 20' defined by a third oblique section 13' extending between the left edge 12' and a third gusset end 15' positioned on the external side 11*b*' and by a fourth oblique section 17' extending between said left edge 12' and a fourth gusset end 19' positioned on the internal side 11*a*'. The pieces of fabric 10 and 10' may advantageously be disposed such that the external side 11*b*' of the piece of fabric 10' is in contact with or close to the internal side 11*a* of the piece of fabric 10 and such that the first, second, third and fourth gusset ends 15, 19, 15', 19' are substantially aligned.

Figure 5A:
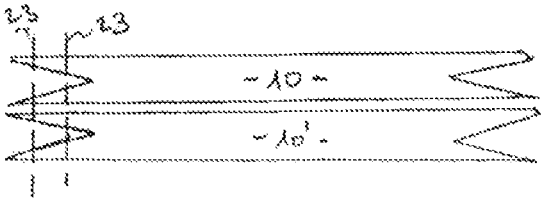
FIGS. 5 and 5*a* are similar views to FIGS. 4 and 4*a*, but illustrating partially a first embodiment of the present invention in which the pair of double-thickness pieces of fabric are assembled by means of seams only.
Figure 5:
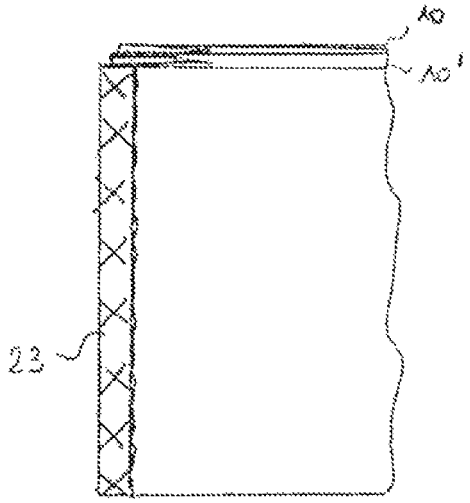

In the first embodiment illustrated in FIGS. 5 and 5*a*, the pieces of fabric 10 and 10' are finally assembled together by means of seams 23 formed around or near the first to fourth gusset ends 15, 19, 15', 19'. These seams 23 are properly positioned to connect together the first to fourth oblique sections 13, 17, 13', 17'. Thus configured, the seams 23 permit that stresses applied to the pieces of fabric 10, 10' are distributed on the first to fourth oblique sections 13, 17, 13', 17' and not concentrated only on a single connection line. Thus, a bag formed by a combination of several pieces of fabric assembled in accordance with the method illustrated in FIGS. 1 to 5, respectively 1*a* to 5*a*, may have a better resistance to stress. In particular, several tests have shown that the bags according to the invention are substantially stronger than the bags produced by a method according to U.S. Pat. No. 8,950,346 B2. Some tests have shown 1.5 time improvements in the resistance at break.

Figure 6:
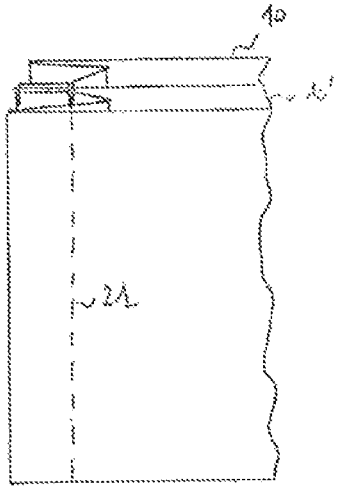
FIGS. 6, 6*a* and 6*b* are similar views to FIGS. 4 and 4*a*, but illustrating partially a second embodiment of the present invention in which the second and third oblique sections of the pair of double-thickness pieces of fabric are firstly connected together by stitching and, optionally, by welding for FIG. 6*b*, before the assembling of the pair of double-thickness pieces of fabric by means of seams.
Figure 6A:
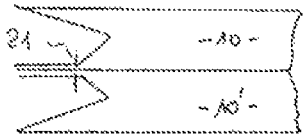

In the second embodiment illustrated in FIGS. 6 and 6*a*, the pieces of fabric 10 and 10' are then connected together by means of a stitching or a welding extending between the second and third oblique sections 17 and 13'. Therefore, this stitching or welding does not connect together the first and fourth oblique sections 13 and 17'. As illustrated in FIGS. 6 and 6*a*, the stitching or welding extends along a single connection line 21. To prevent any loss of content through the perforation made by the needles during the stitching operation, a sewing machine according to FIG. 4 of U.S. Pat. No. 8,950,346 B2 may advantageously be used and the steps defined in claims 1 to 8 of U.S. Pat. No. 8,950,346 B2 may be carried out to form the connection line 21. Accordingly, the method of the present invention may advantageously comprise the step of providing a sewing machine equipped with at least two needles, feeding each needle with a thread and operating said needles in-line one behind the other in one and the same direction so as to produce a seam along the connection line 21 with a stitch formed by the second needle being made on the thread of a stitch formed by the first needle, the stitch formed by the second needle covering a perforation produced by the first needle, and a perforation produced by the second needle being thus made through the thread, thereby filling the perforation with the thread. Furthermore, the method of the present invention may further comprise the step of controlling the needles such that the needles work alternately, and at equivalent stitch distances, and/or such that the second needle perforates the fabric in the middle of the stitch of the first needle. Finally, the threads fed into the needles of the sewing machine may advantageously comprise multi-filament threads with a textured structure. In the conventional bags, these multi-filaments threads are positioned on the external sides thereof, thus leading to a deconstruction of the threads by contact with an adjacent bag. On the contrary, in the bag of the present invention, the connection line 21 is advantageously positioned so as to be protected by the first and fourth oblique sections 13 and 17', thus preventing a contact with another bag.

Figure 6B:
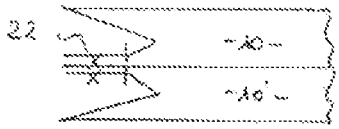

FIG. 6*b* illustrates an optional step consisting to connect together the second and third oblique sections 13 and 17' by means of a welding, said welding extending along a line 22 extending between the connection line 21 and the virtual plane defined by the first to fourth gusset ends 15, 19, 15', 19'. This welding permits to increase the level of sealing of the bag. Indeed, if any loss of content occurs through the connection line 21, this content is prevented to escape from the bag by means of said welding.

Figure 7:
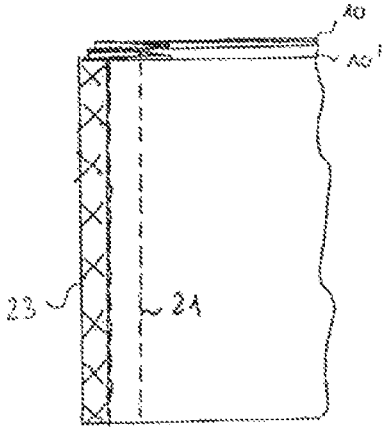
FIGS. 7 and 7*a* are similar views to FIGS. 6 and 6*a*, but illustrating partially the pair of double-thickness pieces of fabric after their assembling by means of seams.
Figure 7A:
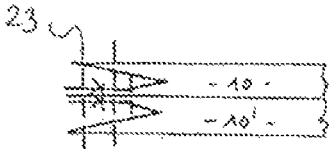

Referring to FIGS. 7 and 7*a*, the pieces of fabric 10 and 10' illustrated in FIGS. 6 and 6*a* or 6*b* are finally assembled together by means of seams 23 formed around or near the first to fourth gusset ends 15, 19, 15', 19'. These seams 23 are properly positioned to connect together the first to fourth oblique sections 13, 17, 13', 17', but being sufficiently distant from the connection line 21 to leave a non-sewn area encompassing this connection line 21 and the left edges 12, 12' of the fabrics 10, 10'. Thus configured, the seams 23 permit that stresses applied to the pieces of fabric 10, 10' are distributed on the first to fourth oblique sections 13, 17, 13', 17' and not concentrated only on the connection line 21. Furthermore, the seams 23 define a sewn area that completely encapsulates the connection line 21, thus avoiding contact between the connection line and a connection line of another bag. This configuration also increases the leakproof properties of the bag. Thus, a bag formed by a combination of several pieces of fabric assembled in accordance with the method illustrated in FIGS. 1 to 7, respectively 1*a* to 7*a*, may have a greater level of sealing than the conventional bags, as well as a better resistance to stress. In particular, several tests have shown that the bags according to the invention are substantially stronger than the bags produced by a method according to U.S. Pat. No. 8,950,346 B2. Some tests have shown 1.5 time improvements in the resistance at break.

Figure 8:
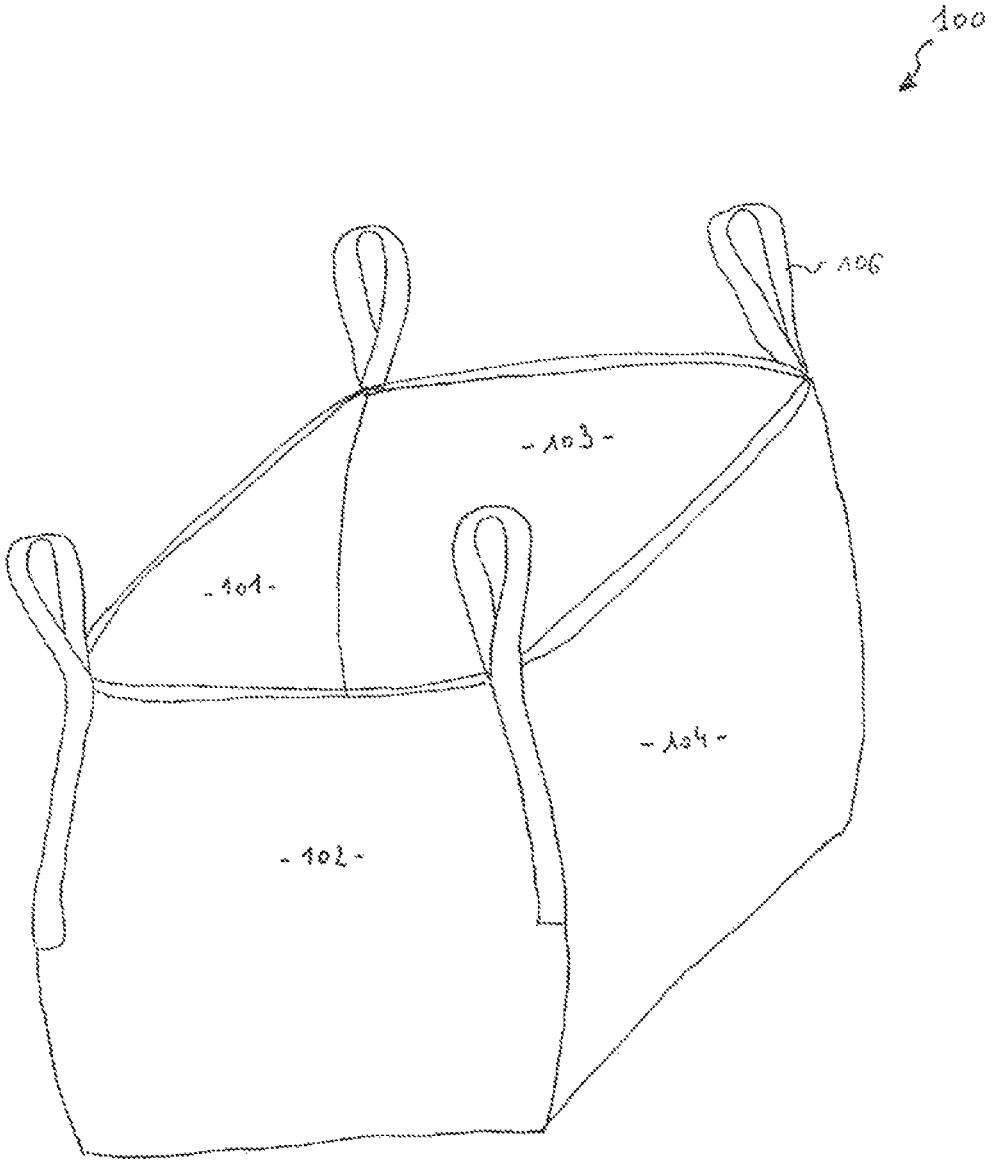
FIG. 8 is a perspective schematic view of a bag according to the present invention.
Figure 9:
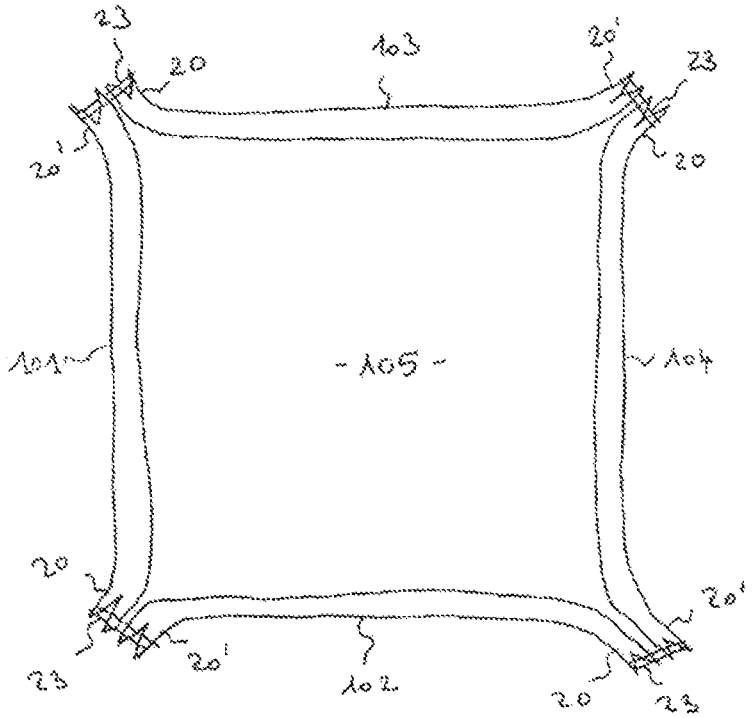
FIG. 9 is a cross-sectional top view of the bag shown in FIG. 8 in the first embodiment of the present invention.

FIGS. 8 and 9 illustrate a bag 100 according to a first embodiment of the present invention. This bag 100 has a parallelepiped shape and is constituted by four double-thickness pieces of fabric 101 to 104 forming the lateral sides of the bag and one piece of fabric 105 forming the bottom side of the bag. The bag 100 is advantageously equipped with four lifting straps 106 positioned at the four upper corners of the bag, whereto forks of forklifts can fit or penetrate. Each double-thickness piece of fabric 101 to 104 comprises a gusset 20, 20' formed at both of its ends, each gusset being connected to a gusset of an adjacent piece of fabric by seams 23. Thus assembled, the double-thickness fabrics 101 to 104 have the same structure as the fabrics 10, 10' illustrated in FIGS. 5 and 5*a*.

Figure 10:
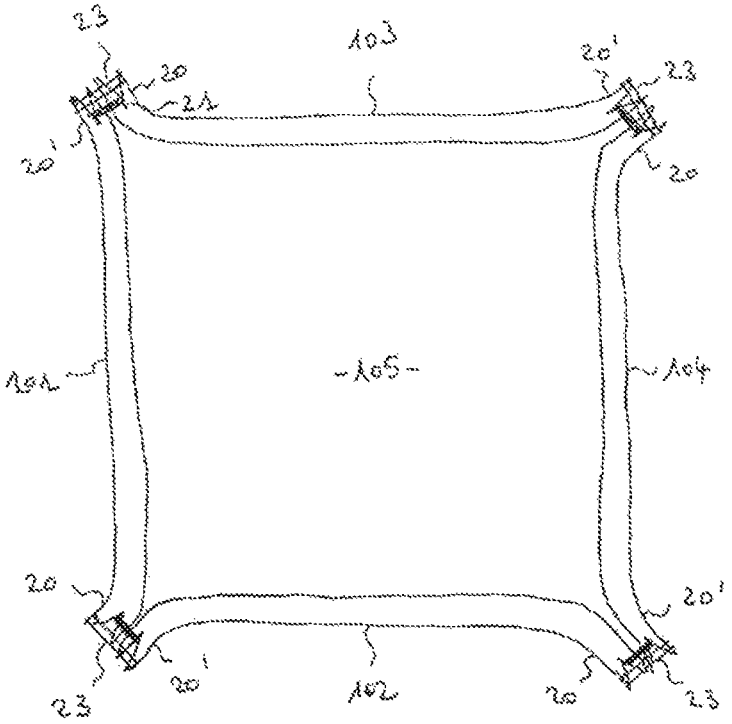
FIG. 10 is a cross-sectional top view of the bag shown in FIG. 8 in the second embodiment of the present invention.

FIGS. 8 and 10 illustrate a bag 100 according to a second embodiment of the present invention. This bag 100 has a parallelepiped shape and is constituted by four double-thickness pieces of fabric 101 to 104 forming the lateral sides of the bag and one piece of fabric 105 forming the bottom side of the bag. The bag 100 is advantageously equipped with four lifting straps 106 positioned at the four upper corners of the bag, whereto forks of forklifts can fit or penetrate. Each double-thickness piece of fabric 101 to 104 comprises a gusset 20, 20' formed at both of its ends, each gusset being connected to a gusset of an adjacent piece of fabric by respectively a stitching or welding 21 and seams 23. Thus assembled, the double-thickness fabrics 101 to 104 have the same structure as the fabrics 10, 10' illustrated in FIGS. 7 and 7*a*.

The invention claimed is:

1. Method for production of bags for the transport and storage of bulk goods or liquids, wherein use is made of tubular fabric cut into several pieces of fabric, which pieces of fabric are then assembled together, comprising the steps of:

providing a tubular fabric;

flattening said tubular fabric to form a double-thickness fabric having two opposite sides, respectively a first side and a second side, extending between first and second flattened edges;

folding-in or pleating the first flattened edge of said double-thickness fabric to form a first gusset, said first gusset being defined by a first oblique section extending between the first folded-in flattened edge and a first gusset end positioned on the second side of the double-thickness fabric and by a second oblique section extending between the first folded-in flattened edge and a second gusset end positioned on the first side of the double-thickness fabric;

folding-in or pleating the second flattened edge in a manner symmetric to said first folded-in flattened edge, cutting said tubular fabric into pieces of fabric and assembling said pieces of fabric to form a bag, wherein the tubular fabric is cut at least into first and second pieces of fabric each comprising the first and second sides, the first and second folded-in flattened edges, the first gusset, the first and second oblique sections and the first and second gusset ends, wherein assembly of the first and second pieces of fabric comprises the steps of:

disposing the first and the second pieces of fabric such that the second side of the second piece of fabric is in contact with or close to the first side of the first piece of fabric and such that the first and second gusset ends of the first and second pieces of fabric are substantially aligned;

assembling the first and second pieces of fabric by means of seams formed around or near the first and second gusset ends of the first and second pieces of fabric.

2. Method according to claim 1, further comprising, before making the seams, the additional step of connecting together the second oblique section of the first piece of fabric and the first oblique section of the second piece of fabric by means of a stitching or a welding, without connecting together the first oblique section of the first piece of fabric and the second oblique section of the second piece of fabric, said stitching or welding extending along a connection line.

3. Method for production of bags for the transport and storage of bulk goods or liquids, wherein use is made of tubular fabric cut into several pieces of fabric, which pieces of fabric are then assembled together, comprising the steps of:

providing a tubular fabric;

flattening said tubular fabric to form a double-thickness fabric having two opposite sides, respectively a first side and a second side, extending between first and second flattened edges;

folding-in or pleating the first flattened edge of said double-thickness fabric to form a first gusset, said first gusset being defined by a first oblique section extending between the first folded-in flattened edge and a first gusset end positioned on the second side of the double-thickness fabric and by a second oblique section extending between the first folded-in flattened edge and a second gusset end positioned on the first side of the double-thickness fabric;

folding-in or pleating the second flattened edge in a manner symmetric to said first folded-in flattened edge, cutting said tubular fabric into pieces of fabric and assembling said pieces of fabric to form a bag, wherein the tubular fabric is cut at least into first and second pieces of fabric each comprising the first and second sides, the first and second folded-in flattened edges, the first gusset, the first and second oblique sections and the first and second gusset ends, wherein assembly of the first and second pieces of fabric comprises the steps of:

disposing the first and the second pieces of fabric such that the second side of the second piece of fabric is in contact with or close to the first side of the first piece of fabric and such that the first and second gusset ends of the first and second pieces of fabric are substantially aligned;

assembling the first and second pieces of fabric by means of seams formed around or near the first and second gusset ends of the first and second pieces of fabric, further comprising, before making the seams, the additional step of connecting together the second oblique section of the first piece of fabric and the first oblique section of the second piece of fabric by means of a stitching or a welding, without connecting together the first oblique section of the first piece of fabric and the second oblique section of the second piece of fabric, said stitching or welding extending along a connection line, and the additional step of connecting together the second oblique section of the first piece of fabric and the first oblique section of the second piece of fabric by means of a welding, said welding extending along a line extending between the connection line and the first and second gusset ends of the first and second pieces of fabric.

4. Method for production of bags for the transport and storage of bulk goods or liquids, wherein use is made of tubular fabric cut into several pieces of fabric, which pieces of fabric are then assembled together, comprising the steps of:

providing a tubular fabric;

flattening said tubular fabric to form a double-thickness fabric having two opposite sides, respectively a first side and a second side, extending between first and second flattened edges;

folding-in or pleating the first flattened edge of said double-thickness fabric to form a first gusset, said first gusset being defined by a first oblique section extending between the first folded-in flattened edge and a first gusset end positioned on the second side of the double-thickness fabric and by a second oblique section extending between the first folded-in flattened edge and a second gusset end positioned on the first side of the double-thickness fabric;

folding-in or pleating the second flattened edge in a manner symmetric to said first folded-in flattened edge, cutting said tubular fabric into pieces of fabric and assembling said pieces of fabric to form a bag, wherein the tubular fabric is cut at least into first and second pieces of fabric each comprising the first and second sides, the first and second folded-in flattened edges, the first gusset, the first and second oblique sections and the first and second gusset ends, wherein assembly of the first and second pieces of fabric comprises the steps of:

disposing the first and the second pieces of fabric such that the second side of the second piece of fabric is in contact with or close to the first side of the first piece of fabric and such that the first and second gusset ends of the first and second pieces of fabric are substantially aligned;

assembling the first and second pieces of fabric by means of seams formed around or near the first and second gusset ends of the first and second pieces of fabric, further comprising, before making the seams, the additional step of connecting together the second oblique section of the first piece of fabric and the first oblique section of the second piece of fabric by means of a stitching or a welding, without connecting together the first oblique section of the first piece of fabric and the second oblique section of the second piece of fabric, said stitching or welding extending along a connection line, wherein the step of connecting together the second oblique section of the first piece of fabric and the first oblique section of the second piece of fabric by means of a stitching comprises the steps of providing a sewing machine equipped with at least two needles, feeding each needle with a thread and operating said needles in-line one behind the other in one and the same direction so as to produce a seam along the connection line with a stitch formed by the second needle being made on the thread of a stitch formed by the first needle, the stitch formed by the second needle covering a perforation produced by the first needle, and a perforation produced by the second needle being thus made through the thread, thereby filling the perforation with the thread.

5. Method according to claim 3, wherein the step of connecting together the second oblique section of the first piece of fabric and the first oblique section of the second piece of fabric by means of a stitching comprises the steps of providing a sewing machine equipped with at least two needles, feeding each needle with a thread and operating said needles in-line one behind the other in one and the same direction so as to produce a seam along the connection line with a stitch formed by the second needle being made on the thread of a stitch formed by the first needle, the stitch formed by the second needle covering a perforation produced by the first needle, and a perforation produced by the second needle being thus made through the thread, thereby filling the perforation with the thread.

6. Method according to claim 5, further comprising the step of controlling the needles such that the needles work alternately, and at equivalent stitch distances.

7. Method according to claim 5, further comprising the step of controlling the needles such that the second needle perforates the fabric in the middle of the stitch of the first needle.

8. Method according to claim 5, wherein the threads fed into the needles of the sewing machine comprise multi-filament threads with a textured structure.

9. Method for production of bags for the transport and storage of bulk goods or liquids, wherein use is made of tubular fabric cut into several pieces of fabric, which pieces of fabric are then assembled together, comprising the steps of:

providing a tubular fabric;

flattening said tubular fabric to form a double-thickness fabric having two opposite sides, respectively a first side and a second side, extending between first and second flattened edges;

folding-in or pleating the first flattened edge of said double-thickness fabric to form a first gusset, said first gusset being defined by a first oblique section extending between the first folded-in flattened edge and a first gusset end positioned on the second side of the double-thickness fabric and by a second oblique section extending between the first folded-in flattened edge and a second gusset end positioned on the first side of the double-thickness fabric;

folding-in or pleating the second flattened edge in a manner symmetric to said first folded-in flattened edge, cutting said tubular fabric into pieces of fabric and assembling said pieces of fabric to form a bag, wherein the tubular fabric is cut at least into first and second pieces of fabric each comprising the first and second sides, the first and second folded-in flattened edges, the first gusset, the first and second oblique sections and the first and second gusset ends, wherein assembly of the first and second pieces of fabric comprises the steps of:

disposing the first and the second pieces of fabric such that the second side of the second piece of fabric is in contact with or close to the first side of the first piece of fabric and such that the first and second gusset ends of the first and second pieces of fabric are substantially aligned;

assembling the first and second pieces of fabric by means of seams formed around or near the first and second gusset ends of the first and second pieces of fabric, further comprising, before making the seams, the additional step of connecting together the second oblique section of the first piece of fabric and the first oblique section of the second piece of fabric by means of a stitching or a welding, without connecting together the first oblique section of the first piece of fabric and the second oblique section of the second piece of fabric, said stitching or welding extending along a connection line, wherein the seams are configured to leave a non-sewn area encompassing the connection line and the first folded-in flattened edges of said first and second pieces of fabric.

10. Method according to claim 3, wherein the seams are configured to leave a non-sewn area encompassing the connection line and the first folded-in flattened edges of said first and second pieces of fabric.

11. Method according to claim 4, further comprising the step of controlling the needles such that the needles work alternately, and at equivalent stitch distances.

12. Method according to claim 4, further comprising the step of controlling the needles such that the second needle perforates the fabric in the middle of the stitch of the first needle.

13. Method according to claim 4, wherein the threads fed into the needles of the sewing machine comprise multi-filament threads with a textured structure.

* * * * *